United States Patent [19]

Bottemiller

[11] Patent Number: 4,592,126

[45] Date of Patent: Jun. 3, 1986

[54] METHOD FOR CONSTRUCTING FURNITURE HAVING A FLEXIBLE SHEET PORTION

[75] Inventor: Donald L. Bottemiller, Wadena, Minn.

[73] Assignee: Homecrest Industries Incorporated, Wadena, Minn.

[21] Appl. No.: 681,834

[22] Filed: Dec. 14, 1984

[51] Int. Cl.[4] ..... B23P 11/02

[52] U.S. Cl. ..... 29/446; 297/441; 297/449; 29/448

[58] Field of Search ..... 29/446, 448; 160/378, 160/328; 297/441, 449

[56] References Cited

U.S. PATENT DOCUMENTS

| | | | |
|---|---|---|---|
| 2,934,134 | 4/1960 | Adler | 160/378 X |
| 3,248,150 | 4/1966 | Lilienfeld | 160/378 X |
| 4,516,305 | 5/1985 | Unger | 29/448 |

*Primary Examiner*—Howard N. Goldberg
*Assistant Examiner*—Leonard S. Selman
*Attorney, Agent, or Firm*—Kinney & Lange

[57] ABSTRACT

A method for constructing furniture is used to attach a flexible sheet portion in a state of tension to a support structure. The support structure includes first and second spaced-apart longitudinal bars having a plurality of studs and a plurality of cross braces, each cross brace having stud engaging apertures proximate first and second ends. Initially, the bars are attached to the flexible sheet with the studs projecting through the sheet. A first cross brace is attached to a first bar by inserting a first stud of the first bar through an aperture of the cross brace. A tool having a handle portion, a shank portion and a distal end portion with a stud engaging recess is inserted through a second aperture of the first cross brace. A second stud of the second bar is engaged by the recess of the distal end portion and the tool is tilted away from the center of the sheet, placing the sheet in tension, while the cross brace is slid down the shank of the tool against the sheet and the second bar. The tool is then removed so that the second stud extends through the second aperture of the cross brace.

7 Claims, 8 Drawing Figures

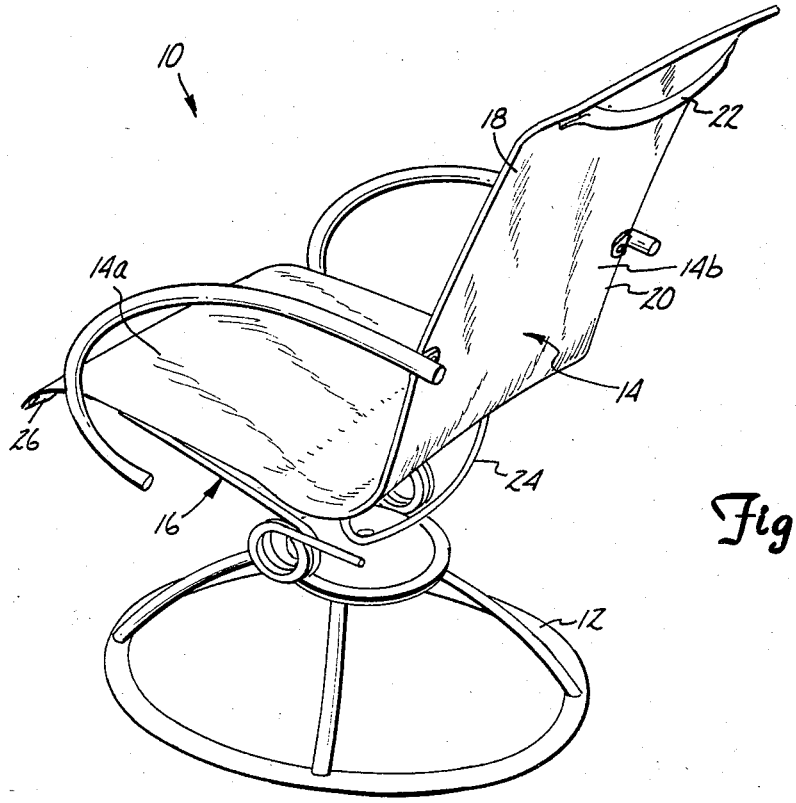
Fig. 1
Fig. 2
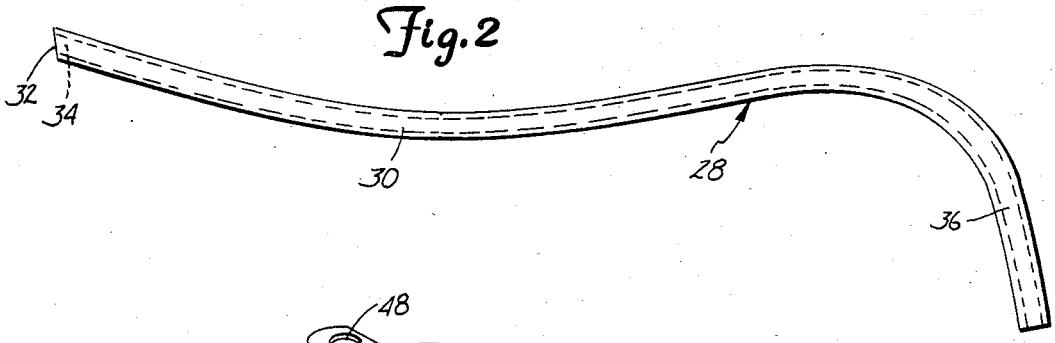
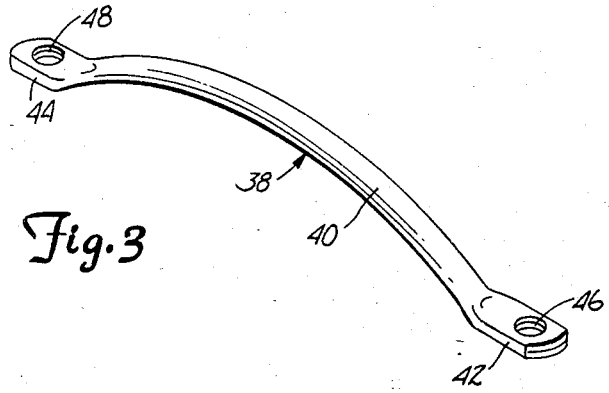
Fig. 3

METHOD FOR CONSTRUCTING FURNITURE HAVING A FLEXIBLE SHEET PORTION

BACKGROUND OF THE INVENTION

1. Field of the Invention

The present invention relates to the construction of furniture, and in particular, it relates to the installment of a flexible sheet in tension in a furniture construction.

2. Description of the Prior Art

Outdoor furniture having strips of flexible material or entire sheets of flexible material stretched over metal framework have become quite popular. This type of outdoor furniture is typically left outside and exposed to the elements, sometimes for months at a time. The fabric that is stretched over metal framework deteriorates from usage and exposure and requires periodic replacement. In the case of fabric strips, the strips are typically replaced by simply stretching the fabric strips over the metal framework and securing it thereto with screws, rivets, or the like. However, in the case of outdoor furniture having a single sheet of fabric stretched over a framework, difficulties arise in securing the fabric to the framework so that the fabric is in the same state of tension as originally manufactured. The problem is even greater when the support structure that holds the fabric is of an arrangement such that the fabric and the support structure are assembled together to form the piece of furniture.

SUMMARY OF THE INVENTION

The present invention includes a method of constructing furniture having a flexible sheet in tension and supported by first and second spaced-apart longitudinal bars held apart by a plurality of cross braces. The longitudinal bars have a plurality of studs and the cross braces have apertures proximate their ends for engagement with the studs of the bars. The sheet is preferably of an envelope construction and the bars are positioned within the envelope with the studs extending through one side of the sheet. A tool is used to attach the cross braces to the first and second spaced apart longitudinal bars while placing the sheet in tension. The tool preferably has a beveled distal end portion, a curved shank portion and a handle portion. The distal end portion has a bolt engaging recess and is beveled such that a leading edge of the beveled end portion is diposed on the concave side of the curved shank portion.

The method includes inserting a first stud of the first bar through an aperture located proximate one end of a first cross brace and inserting the tool through a second aperture located proximate another end of the first cross brace with the sheet positioned between the cross brace and the bar. The tool is positioned so that the convex side of the shank portion and the leading edge of the beveled end are facing the center of the sheet. The recessed end of the tool acts as a fulcrum by engaging a second stud of the second bar. The tool is pivoted on the second stud to position the second aperture of the cross brace over the stud. The cross brace is moved down along the tool onto the stud. After the cross brace is positioned so that the stud extends through the aperture, the tool is turned so that the leading edge of the beveled end faces away the center of the sheet permitting easy disengagement of the tool from the cross brace and stud. The cross brace is then secured to the stud with a nut. The remaining cross braces are attached in a similar manner.

BRIEF DESCRIPTION OF THE DRAWINGS

FIG. 1 is a perspective view of a chair constructed by the method of the present invention.

FIG. 2 is an elevational view of the tool used in constructing the chair.

FIG. 3 is a perspective view of a cross brace of the chair.

DETAILED DESCRIPTION OF THE PREFERRED EMBODIMENTS

Figure 4:
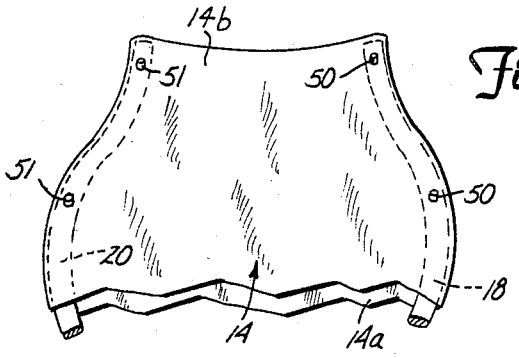
FIG. 4 is a perspective view of a portion of a flexible sheet and longitudinal bars disposed within an envelope of the sheet.

A chair, generally indicated at 10 in FIG. 1, is constructed by the method of the present invention. The chair 10 includes a ground-engaging support stand 12, a one-piece flexible sheet 14, and a support structure 16 for supporting and holding in tension the flexible sheet portion 14 and forming a seat portion of the chair.

As used within this application, the term "constructing" refers to both original construction of furniture and reconstruction of furniture to replace the flexible sheet. The method of the present invention is preferably used to replace the flexible sheet when the original sheet has deteriorated. When originally manufactured, the seat portion of the chair was formed with the sheet 14 being placed in a high state of tension. The typical owner of the chair does not have the means to install a replacement sheet so that the sheet is installed in the same state of tension as originally manufactured. The method of the present invention permits the owner to install a replacement sheet quickly and without great effort in a state of tension as the manufacturer had.

The flexible sheet 14 is preferably an envelope with an upper layer 14*a* and a lower layer 14*b*. The sheet is made of a flexible fabric, such as a vinyl-coated polyester fabric suitable for use in an outdoor environment.

The support structure 16 includes first and second spaced apart longitudinal bars 18 and 20. The bars 18 and 20 are held apart by cross braces 22, 24 and 26. In the chair illustrated in FIG. 1, the cross brace 24 secures the support structure 16 to the stand 12. It should be understood that the number of cross braces may vary depending on the type of chair, lounge, swing chair, or other similar furniture construction that utilizes a single flexible sheet and similar support structure.

A tool generally indicated at 28 in FIG. 2, is used to attach the cross braces to the first and second longitudinal bars, placing the sheet 14 in tension. The tool 28 includes a curved shank section 30 having a beveled end 32 with a stud-engaging recess 34. The tool 28 further includes a handle section 36 disposed in a generally transverse direction to the curved section 30. The handle 36 permits the user to easily twist the tool about the end 32, as is discussed subsequently.

The longitudinal bars 18 and 20 preferably have a contour that defines the shape of the chair illustrated in FIG. 1. When the sheet 14 is stretched between the bars 18 and 20, the sheet conforms to the contour of the bars 18 and 20.

An example of the cross braces 22, 24 and 26 is indicated by reference character 38 in FIG. 3. The cross brace 38 has a generally arcuate central portion 40 with first and second end portions 42 and 44, respectively. The first end portion 42 includes an aperture 46 and the second end portion 44 includes an aperture 48. The aperture 48 is slightly larger than the aperture 46 and is sufficiently large to accept the shank section 30 of the tool 28.

The longitudinal bars 18 and 20 include a plurality of studs 51 and 50, respectively, for engagement with the cross braces 22, 24 and 26, as illustrated in FIG. 4. Preferably, the longitudinal bars 18 and 20 are positioned between the two layers of the sheet portion with the studs 51 and 50 protruding through holes in the lower layer **14*b*. As will be easily understood, the sheet 14 conforms to the contour of the bars 18 and 20 forming the seat portion of the chair illustrated in FIG. 1**.

Figure 5:
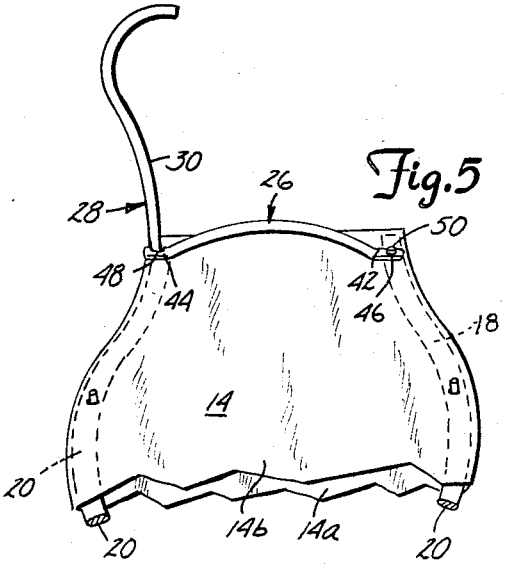
FIG. 5 is a perspective view of a portion of the flexible sheet portion illustrating the placement of a cross brace using the tool illustrated in FIG. 2.

After the longitudinal members 18 and 20 are positioned between the layers **14*a* and 14*b*, the end portion 42 of the cross brace 26 is attached to the bar 18 by inserting the stud 50 through aperture 46, as illustrated in FIG. 5**.

Figure 6:
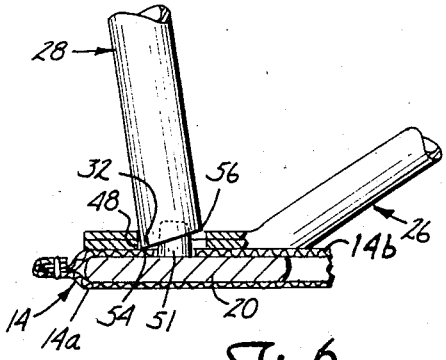
FIG. 6 is a sectional view with portions shown whole to illustrate the engagement of the cross brace and a stud of the longitudinal bar by the tool.

With end 42 being held in engagement by the stud 50, the curved shank section 30 of the tool is inserted through the larger aperture 48 of the end 44 of the cross brace. The handle section 36 is positioned to face the center of the sheet 14. The curved shank portion 30 is initially tilted slightly towards the center of the sheet 14 and beveled end 32 is positioned to engage the stud 51 of the bar 20, as illustrated in FIG. 6. The tool 28 is then tilted to a generally more upright position and the cross brace 26 is slid downwardly along the shank portion 30 until the cross brace meets the layer **14*b* adjacent the bar 20**.

It will be appreciated that the tool 28 acts as a lever with the fulcrum point being located at the point of engagement between the end 32 of the tool and the stud 51. In one working example, the tool was approximately 14 inches in height, providing a sufficient amount of leverage so that the sheet 14 is stretched tautly between the bars 18 and 20.

Figure 7:
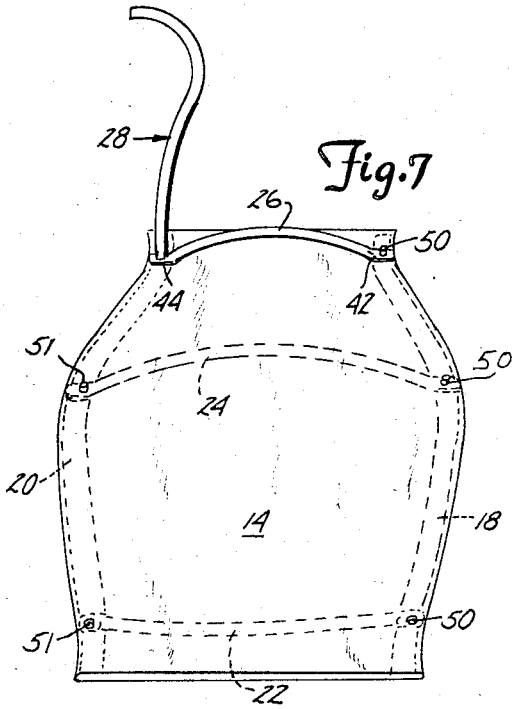
FIG. 7 is a perspective view of the flexible sheet portion illustrating the position of the tool for disengagement from the stud of the longitudinal bar.

After the end portions 42 and 44 of the cross brace are positioned against the bars 18 and 20 and connected with the studs 50 and 51 extending through the respective apertures, the end portions of the cross brace are held against the layer **14*b* and the tool 28 is grasped by the handle section 36 and twisted so that the handle section faces away from the center of the sheet 14, as illustrated in FIG. 7. The effect is that the beveled end 32 faces away from the center of the sheet 14** against the force of tension.

Figure 8:
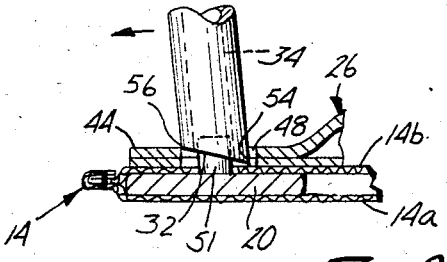
FIG. 8 is a sectional view with portions shown whole to illustrate the position of the end of the tool for disengagement of the tool from the stud of the longitudinal bar.

As illustrated in FIG. 8, the beveled end 32 has a leading edge 54 and a trailing edge 56. The end 32 is beveled so that the trailing edge 56 is disposed beyond the aperture 48 when the leading edge 54 is held against the layer **14*b* and the bar 20, as illustrated in FIGS. 6 and 8. When the tool 28 is in the position illustrated in FIG. 6, the walls of the aperture 48 are held against the surface of the tool proximate the leading edge 54 due to the tension of the sheet 14. Removal of the tool so that the tool disengages from the brace in this position is difficult since the brace 26 is in frictional contact with the tool 28**.

The beveled end 32 eliminates this problem. When the tool 28 is turned to position the leading edge 54 of the beveled end toward the center of the sheet 14, the wall of the aperture 48 disengages from the tool 28 to engage the stud 51. The tool 28 is then easily removed from the aperture 48, leaving the brace 26 in engagement with the stud 51.

Nuts are then threaded onto the studs to retain the brace 26 in place. The remaining cross braces 24 and 22 are attached in a similar fashion. The seat portion of the chair formed by the support structure 16 and sheet 14, is then affixed to a suitable support stand as illustrated in FIG. 1.

Although the present invention has been described with reference to preferred embodiments, workers skilled in the art will recognize that changes may be made in form and detail without departing from the spirit and scope of the invention.

What is claimed is:

1. A method for constructing furniture having a flexible sheet in a state of tension supported by first and second spaced-apart longitudinal bars having a plurality of studs and a plurality of cross braces, each cross brace having stud engaging apertures proximate first and second ends, using a tool having a handle portion, a shank portion and a distal end portion with a stud engaging recess, the method comprising:

attaching the longitudinal bars to the flexible sheet such that the bars are held in a fixed position relative to the sheet and define a body support section therebetween with the studs projecting through the sheet;

inserting a first stud of the first bar through an aperture of a first cross brace;

inserting the tool through a second aperture of the first cross brace;

engaging a second stud of the second bar with the stud engaging recess of the tool;

tilting the tool away from the center of the sheet and sliding the first cross brace down the tool until the cross brace is positioned against the sheet; and removing the tool from engagement with the second stud so that the second stud extends through the second aperture.

2. The method of claim 1 wherein the flexible sheet has first and second layers defining an envelope and wherein the longitudinal bars are attached to the flexible sheet by inserting the longitudinal bars between the first and second layers with the studs of the bars projecting through the first layer of the sheet.

3. The method of claim 1 wherein the tool has a beveled end surface having a leading edge and a trailing edge and wherein the leading edge of the tool is disposed on a side of the second stud away from the center of the sheet when the tool is initially inserted through the second aperture and is engaged with the second stud, and turning the tool after the cross brace is positioned against the sheet so that the trailing edge of the beveled end surface faces away from the center of the sheet, disengaging the cross brace from the tool so that the cross brace engages the second stud.

4. The method of claim 3 wherein the shank portion of the tool is curved and wherein the tool is inserted through the second aperture of the first cross brace with a concave configured side of the shank portion facing the center of the sheet, and the tool being tilted away from the center of the sheet using the stud as a fulcrum to place the sheet in tension while using the curved shank portion to slide the cross brace to a position against the sheet.

5. The method of claim 4 wherein the handle portion of the tool is disposed in a direction generally transverse to the shank portion and turning the tool by grasping the handle portion.

6. The method of claim 1 and further including:

attaching the remaining cross braces to the first and second longitudinal bars according to the steps of claim 1.

7. The method of claim 6 wherein the studs have threaded ends and further including:

threading nuts onto the threaded ends of the studs to retain the cross members in engagement with the studs.

* * * * *